US010939734B2

(12) United States Patent
Chinalai

(10) Patent No.: US 10,939,734 B2
(45) Date of Patent: Mar. 9, 2021

(54) SAFETY CLASP FOR A NECKLACE

(71) Applicant: Andrea Hope Chinalai, Miller Place, NY (US)

(72) Inventor: Andrea Hope Chinalai, Miller Place, NY (US)

( * ) Notice: Subject to any disclaimer, the term of this patent is extended or adjusted under 35 U.S.C. 154(b) by 127 days.

(21) Appl. No.: 16/058,963

(22) Filed: Aug. 8, 2018

(65) Prior Publication Data

US 2020/0046089 A1 Feb. 13, 2020
US 2021/0037931 A9 Feb. 11, 2021

Related U.S. Application Data

(60) Provisional application No. 62/542,431, filed on Aug. 8, 2017.

(51) Int. Cl.
*A44C 5/20* (2006.01)
*A44B 99/00* (2010.01)

(52) U.S. Cl.
CPC ..... *A44C 5/2076* (2013.01); *A44B 99/00* (2013.01); *A44D 2203/00* (2013.01)

(58) Field of Classification Search
CPC ... A44C 5/2076; A44D 2203/00; Y10T 24/32; Y10T 24/3913; Y10S 63/90; H01F 7/0263
See application file for complete search history.

(56) References Cited

U.S. PATENT DOCUMENTS 1,590,781 A * 6/1926 Tate ..... A44C 5/2057 24/587.11
1,626,138 A * 4/1927 Kohn ..... A44C 5/185 24/115 R
2,164,206 A * 6/1939 Gits ..... E06B 9/326 16/442
2,955,379 A * 10/1960 Dell ..... A01K 95/00 43/42.35

(Continued)

FOREIGN PATENT DOCUMENTS

CN 2759255 Y 2/2006
CN 2759255Y A 2/2006

OTHER PUBLICATIONS

Chinese Patent Application 201721408051.3, First Office Action dated Apr. 28, 2018—Chinese.

(Continued)

*Primary Examiner* — Joshua T Kennedy
(74) *Attorney, Agent, or Firm* — Ira Stickler, Esq.

(57) ABSTRACT

A clasp for a necklace including a string, the clasp being configured to join a first and second free end of a string. The clasp including a first part and a second part and is transitionable between an open when then surfaces of the first and second parts are spaced apart from one another and a closed condition when the surfaces of the first and second parts are positioned on one another. The first and second parts including surfaces configured to be releasably attached to one another by a magnetic connection. The first and second parts (Continued)

each including a throughhole extending lengthwise along an axis extending along a length of the first and second parts, the surfaces of the first and second part being generally transverse to the axis, the throughhole being configured to receive and secure a portion of the string therein.

13 Claims, 6 Drawing Sheets

(56) References Cited

U.S. PATENT DOCUMENTS 3,129,477 A * 4/1964 Mizuno ..... A44C 5/2076 24/303
5,367,891 A * 11/1994 Furuyama ..... A44C 5/2057 24/303
6,964,361 B2 * 11/2005 Kathrein ..... A45C 1/04 224/183
7,708,421 B2 * 5/2010 Underdown ..... A44C 15/0015 362/103
8,113,013 B2 * 2/2012 Kessler ..... A44C 5/2076 63/3
8,276,245 B2 * 10/2012 Huang ..... E06B 9/326 160/178.1 R
9,101,185 B1 * 8/2015 Greenberg ..... A44C 5/20
2005/0138963 A1 * 6/2005 Williams ..... A44C 5/2076 63/35
2008/0271296 A1 * 11/2008 Jepsen ..... A44C 5/185 24/265 EC
2014/0053374 A1 * 2/2014 Jepsen ..... A44C 5/18 24/303
2017/0224066 A1 * 8/2017 Sozio ..... A44C 13/00
2018/0200152 A1 * 7/2018 Price ..... A61J 17/02

OTHER PUBLICATIONS

Chinese Patent Application 201721408051.3, Letter Explaining the First Office Action dated Apr. 28, 2018—English.
Chinese Patent Application 201721408051.3, Second Office Action dated Aug. 15, 2018—Chinese.
Chinese Patent Application 201721408051.3, Letter Explaining the Second Office Action dated Aug. 15, 2018—English.
Chinese Patent Application 201721408051.3, Third Office Action dated Feb. 2, 2019—Chinese.
Chinese Patent Application 201721408051.3, Letter Explaining the Third Office Action dated Feb. 27, 2019—English.

* cited by examiner

SAFETY CLASP FOR A NECKLACE

CROSS REFERENCE TO RELATED APPLICATIONS

This application claims the benefit of and priority to U.S. Prov. App. No. 62/542,431 titled "Safety Clasp for a Necklace" filed Aug. 8, 2017, the contents of which are incorporated herein in its entirety by reference.

FIGURE SELECTED FOR PUBLICATION

FIG. 1

BACKGROUND

Technical Field

The present disclosure generally relates to a clasp for a necklace or a bracelet, and more particularly to a safety clasp for use with a teething necklace.

Description of the Related Art

Teething is the process by which an infant's first teeth sequentially appear by emerging through the gums. During this process, the infant's gums are often sore. Applying pressure to the gums may relieve the pain associated with the sore gums.

Some parents provide their infants with rubber or plastic toys designed for their teething babies to chew or suck upon. In particular, teething necklaces or bracelets may help relieve their infants' teething pain by providing the infants with something handy on which to chew or manipulate between their sore gums. Since necklaces and bracelets are worn, they may be advantageous because they are less likely to be lost as compared to other toys that are not worn.

While a teething necklace has some advantages over other teething toys, conventional necklaces may pose a safety hazard because objects worn around the neck may pose a risk of suffocating the infant. For example, in the event that the necklace were to get caught on an object, the necklace may exert pressure on the infant's neck, thereby strangling or suffocating the infant. Further, even when teething necklaces are not worn by the infant and are instead worn by a parent, for example, such that the infant can teeth on the necklace while being supervised, the force that the infant applies to the necklace might result in the necklace breaking or otherwise failing.

It would be desirable for necklaces, including teething necklaces, that are worn by infants to include features that may reduce the risk of strangulation or suffocation.

SUMMARY

The present disclosure relates to a safety clasp for a necklace or a wristband.

In an embodiment, a clasp for a necklace including a string, the clasp being configured to join a first and second free end of a string, the clasp including a first part; a second part, the clasp being transitionable between an open condition and a closed condition, the clasp being configured to transition to the open condition in response to a tensile force of a predetermined magnitude pulling the first and second parts away from one another; and throughholes extending lengthwise along respective axes extending along respective lengths of the first and second parts, the throughholes being configured to receive and secure a portion of the string therein such that the string is secured to the clasp. The first part may include a first surface and the second part includes a second surface, the first and second surfaces being magnetically attracted to one another. At least one of the first and second parts may include a magnet and the other of the at least one of the first and second parts includes a ferrous material, the magnet being magnetically attracted to the ferrous material. The first part may include a male part and the second part comprises a female part, the male and female parts exerting a frictional force upon one another such that the first and second parts remain in the closed condition until the tensile force of the predetermined magnitude urging the first and second parts apart from one another. The throughholes may extend through the male and female parts. The string may include knotted first and second ends, the first and second knotted ends inhibiting removal of the string from the throughholes. The clasp may have a prolate spheroid shape (i.e., a football or pill-like shape). When the string is secured to the clasp, pulling on the string with a force of 3.6 lbs relative to the clasp results in the clasp transitioning to the open condition.

In an embodiment, a clasp for a necklace may include a string and may be configured to join a first and a second free end of a string and may include: a first part; a second part, wherein the first part includes a first surface and the second part includes a second surface, the first and second surfaces being magnetically attracted to one another, the clasp being transitionable between an open condition and a closed condition, the clasp being configured to transition to the open condition in response to a tensile force of a predetermined magnitude pulling the first and second parts away from one another, wherein an application of a force upon the first part relative to the second part to effect an angular movement of the first part relative to the second part results in the clasp transitioning to the open condition when the applied force reaches a threshold value, wherein only the magnetic attraction of the first and second parts to one another inhibits the clasp from transitioning to the open condition; and throughholes extending lengthwise along respective axes extending along respective lengths of the first and second parts, the throughholes being configured to receive and secure a portion of the string therein such that the string is secured to the clasp.

In an embodiment, a necklace system including a string may include the above-described clasp for joining ends of the string and providing a locking mechanism.

The above and other aspects, features and advantages of the present disclosure will become apparent from the following description read in conjunction with the accompanying drawings, in which like reference numerals designate the same elements.

BRIEF DESCRIPTION OF THE DRAWINGS

A further understanding of the present disclosure can be obtained by reference to a preferred embodiment set forth in the illustrations of the accompanying drawings. Although the illustrated preferred embodiment is merely exemplary of methods, structures and compositions for carrying out the present disclosure, both the organization and method of the disclosure, in general, together with further objectives and advantages thereof, may be more easily understood by reference to the drawings and the following description. The drawings are not intended to limit the scope of this disclosure, which is set forth with particularity in the claims as appended or as subsequently amended, but merely to clarify and exemplify the disclosure.

For a more complete understanding of the present disclosure, reference is now made to the following drawings in which.

DETAILED DESCRIPTION

As required, a detailed illustrative embodiment of the present disclosure is disclosed herein. However, techniques, systems, compositions and operating structures in accordance with the present disclosure may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present disclosure.

Referring to FIGS. 1-3C, a necklace system 100 including a clasp 110 will be described herein. Although referred to as a necklace system, it is to be understood that the system 100 may be any article of clothing or jewelry that is suitable to be closed by a clasp and that this may include both necklaces and wristbands, for example.

Figure 1:
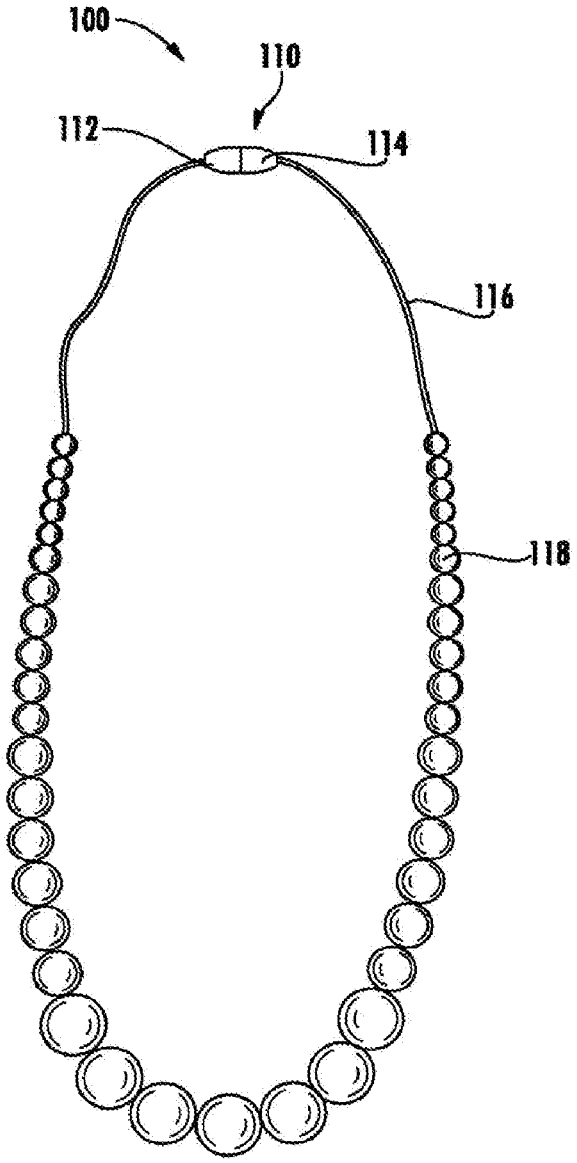
FIG. 1 is a front view of a necklace system including a clasp in accordance with the present disclosure.

As shown in FIG. 1, clasp 110 of the necklace system 100 may include a first part 112 and a second part 114 each of which may be coupled or secured to respective opposing ends of a string 116. The first part 112 and the second part 114 when secured to one another may form a prolate spheroid like shape (i.e., a football or pill-like shape). Although described as a string, element 116 may in some embodiments be formed integrally or irremovably secured, adhered, or welded, for example, to the first and second parts 112, 114. Further, the string 116 may be formed from any suitable material including for example, fibrous materials, plastics, rubbers, etc.

A plurality of beads or elements 118 may be disposed along a length of the string 116. The beads or elements 118 may be coupled to or may be integral with the string 116. The beads or elements 116 may be formed from any suitable material including metal, fabric, polymers, plastic, ceramic, and/or rubber, for example. The beads or elements 118 may help an infant alleviate pain or discomfort associated with teething by chewing or sucking on the beads or elements 118. As described in more detail hereinbelow, the clasp 110 is preferably configured such that the first part 112 and the second part 114 are transitionable between a closed condition and an open condition, and disengage from one another to transition to the open condition upon an application of a tensile force that is at least that is equal to or greater than a predetermined threshold amount.

Figure 2A:
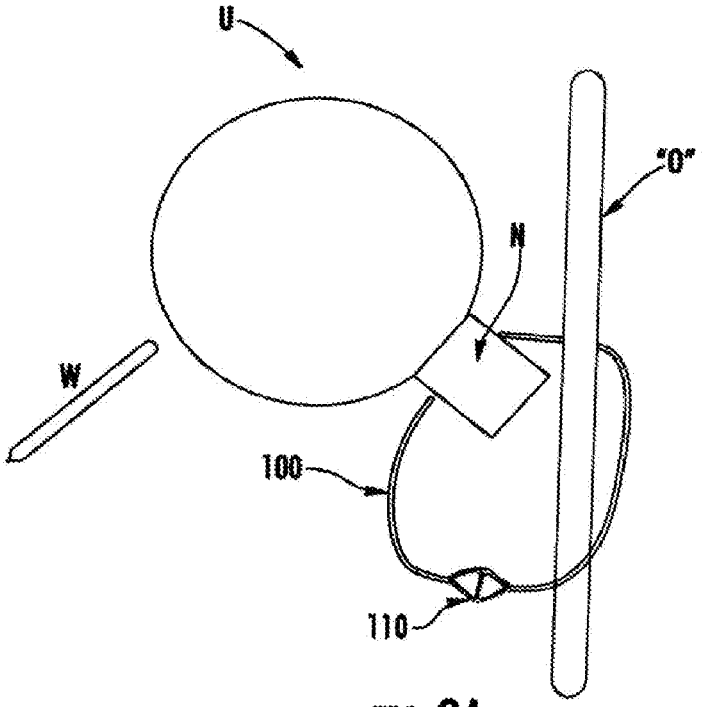
FIG. 2A is an illustration of the necklace system of FIG. 1 shown in use.
Figure 2B:
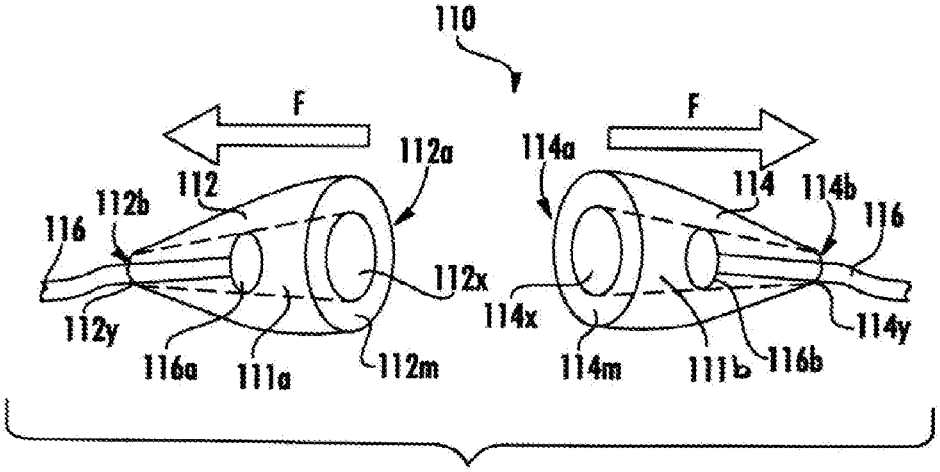
FIG. 2B is an enlarged view of a portion of the necklace system of FIG. 1 shown with the clasp in an open condition.

As shown in FIG. 2A-2B, the first part 112 and the second part 114 are magnetically and releasably securable to one another in a closed condition and will remain in the closed condition until an application of a predetermined tensile force to each of the first part 112 and the second parts 114 of the clasp 110. That is, by pulling the first part 112 and the second part 114 apart from one another, the clasp 110 may transition to the open condition as a force is applied to each of the first part 112 and the second part as indicated by the directional arrows.

The strength of the magnetic attraction at the interface of the first part 112 and the second part 114 may be of a predetermined magnitude such that release or opening of the clasp occurs upon application of a tensile force F of a predetermined magnitude. For example, the body weight W of the user U may exert a force upon the neck N of the user U in the event that the necklace system 100 becomes caught on an object "O". In such an event, a force, e.g., tensile force would be applied to the clasp 110. The forces applied the clasp may cause the first and second parts 112, 114 to pivot relative to one another at the interface where their respective proximal surfaces 112*a*, 114*a* had contacted one another. A conventional clasp would remain closed until a failure in the clasp or the string occurs. The degree of force at which such a conventional clasp or string would occur may be less than the force required to harm the user. Advantageously, the tensile force F necessary to open the clasp 110 is less than the force that would cause a material failure of the necklace system 100 and also less than the force that would otherwise result in bodily injury.

In other words, in response to a predetermined amount of tensile force F upon the clasp, the clasp 110 shall transition to the open condition and the first part 112 shall separate from the second part 114, thereby minimizing the potential for harm to the user U. The magnetic force attracting the first part 112 and second part 114 to one another may be of a magnitude such that during normal wear the first and second parts 112, 114 remain secured to one another but when a sufficient tug or weight is exerted upon the string 116 and/or the clasp 110, the first and second parts 112, 114 shall disengage from one another. In an embodiment, the force of pull on the string 116 and/or the clasp 110 required to transition the clasp 110 to the open condition and separate the first and second parts 112, 114 apart from one another may be 3.6 lbs. However, forces other than 3.6 lbs are within the scope and spirit of the present disclosure to cause the clasp 110 to transition to the open condition upon a predetermined threshold value of the force of tugging upon the string 116 and/or clasp 110 being applied.

It should be noted that it is preferred that an infant not wear the necklace system 100 when unattended and unsupervised by an adult. However, in the event the necklace system 100 were worn by an infant the necklace system 100 has unique safety advantages over conventional necklaces such that the risk that is posed to the infant is reduced. Preferably, the necklace system 100 may be worn by an adult such as when holding the infant. In that situation, the necklace system 100 also provides advantages in that the pull strength to open the clasp is strong enough to keep your necklace secure while baby tugs and chews but weak enough to come open before causing any pain to mom or damage to the necklace. Further, while the necklace system 100 may include a string 116 that includes beads 118 that may be chewed on, it is preferable that the clasp 110 itself not be chewed on.

As shown in FIG. 2B, the first part 112 and the second part 114 may be generally configured to define a prolate spheroid shape when coupled to one another. In particular, the first part 112 may have a proximal end 112*a* and a distal end 112*b*, the proximal end 112*a* having a greater width or diameter than that of the distal end 112*b*. Similarly, the second part 114 may have a proximal end 114*a* and a distal end 114*b*, the proximal end 114*a* having a greater width or diameter than that of the distal end 114*b*.

As discussed, the proximal ends 112*a* and 114*a* are configured to be releasably secured to one another and separable from one another when pulled apart with a predetermined force. For example, the proximal end surfaces 112*a* and 114*a* may be magnetized such that they are releasably and magnetically securable to one another. For example, the proximal end surfaces 112*a* and 114*a* may be magnetized and include respective magnetic or magnetized surfaces 112*m*, 114*m* such that when the magnetized surfaces 112*m*, 114*m* are brought into proximity with one another, the surfaces 112*m* and 114*m* will be magnetically attracted and secured to one another. For example, the magnets 112*m*, 114*m* may have opposing polarities such that they attract one another. Although both elements 112*m* and 114*m* are described as being magnets, alternatively, one of the magnets 112*m* or 114*m* may be substituted with a ferrous material (e.g., steel) such that the remaining magnet 112*m* or 114*m* may be attracted to the ferrous material. The magnets 112*m* and 114*m* may include respective openings 112*x*, 114*x*. As shown in the accompanying figures, openings 112*x*, 114*x* are generally circular. However, the openings 112*x*, 114*x* may have any suitable shape. As shown in FIG. 2A, dashed lines 111 on each of the first and second parts 112, 114 represent a generally conical space 111*a*, 111*b* formed within the respective first and second parts 112, 114, which may be otherwise generally solid.

Advantageously, the proximal end surfaces 112*a*, 114*a* and their respective magnetized surfaces 112*m*, 114*m* when secured to one another may be substantially flush relative to one another such that when applying forces F to separate the first and second parts 112, 114 substantially only magnetic forces (as opposed to frictional forces) inhibit such separation and transition to the open condition of the clasp 110. In contrast, were the first and second parts 112, 114 coupled to one another with male and female parts, the frictional interaction would inhibit separation of the first and second parts 112, 114. In addition, the interaction of such male and female parts of a conventional clasp would limit the direction of forces that would need to be applied to effect separation of the parts of the clasp to a pulling force that is aligned with the central axes of the male and female parts of the clasp; a pivoting motion may not result in opening of the clasp unless the male part breaks, snaps, or otherwise fails from such movement. Advantageously, here, applied forces can be in any direction including, for example bending or pivoting the male and female parts 112, 114 relative to one another, pulling the male and female parts 112, 114 apart along their longitudinally extending axes, or even sliding the male and female parts 112, 114 along their respective proximal end surfaces 112*a*, 114*a* relative to one another to effect separation of the male and female parts 112, 114.

Figure 2C:
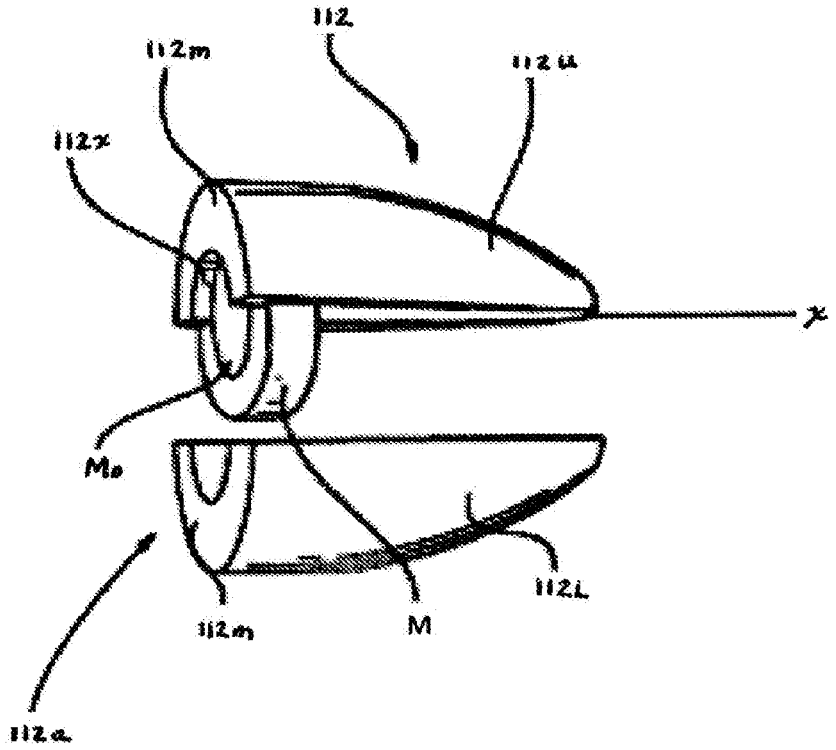
FIG. 2C is a front partially exploded view of a first part of the clasp of FIG. 1.

While the magnetic surfaces 112*m*, 114*m* may be magnetized or formed from a magnetic material at the respective proximal ends 112*a*, 114*a* of the respective first and second parts 112, 114. Alternatively, as shown in FIG. 2C, the interior space of the first and second parts 112, 114 may be generally hollow, and a magnetic element M which may be either a magnet or a ferrous material and may be disposed within at least one of the first and second parts 112, 114. The magnetic element M may be generally cylindrical and imbedded or otherwise fit or secured within at least one of the first and second parts 112, 114. Further, although not shown in FIG. 2C, the magnetic element M may extend to and/or at least partially cover each of the magnetic surfaces 112*m*, 114*m*. The magnetic elements M may frictionally fit within the hollow interiors of the first and second parts 112, 114 in an interference fit relationship such that the magnetic element M when so fit within each of the first and second parts 112, 114 cannot be removed.

Further, at least one of the first and second parts 112, 114 may include a first and a second half to facilitate placement of the magnetic element M within at least one of the first and second parts 112, 114. For example, second part 112 may include an upper half 112U and a second half 112L which may be symmetrical with respect to one another along the length of the second part 112 taken along axis x. The magnetic element M may be disposed within the second part 112 and secured to an inner surface toward the proximal end 112*a* thereof. The magnetic element M may be configured to have a size and shape to approximate the interior dimensions of the second part 112 near the proximal end thereof and include an opening Mo that corresponds in its position and size to the opening 112*x* at the proximal end of the first part 112.

As shown in FIG. 2B, the string 116 may include bulbous or knotted opposing ends 116*a* and 116*b*. When assembled, end 116*a* of the string 116 may be of a dimension that is small enough to fit through opening 112*x* but it large enough to inhibit being pulled through opening 112*y* at the distal end 112*b* of the first clasp 112. Similarly, when assembled, end 116*b* of the string 116 may be of a dimension that is small enough to fit through opening 114*x* but it large enough to inhibit being pulled through opening 114*y* at the distal end 114*b* of the second clasp 114.

Figure 3A:
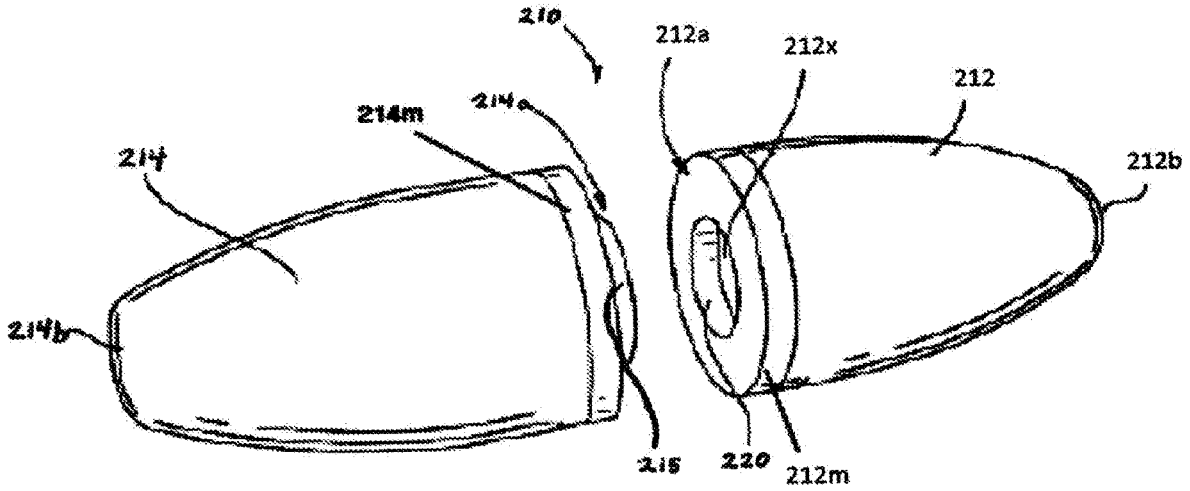
FIG. 3A is a left perspective view of another clasp in accordance with the present disclosure shown in an open condition.
Figure 3B:
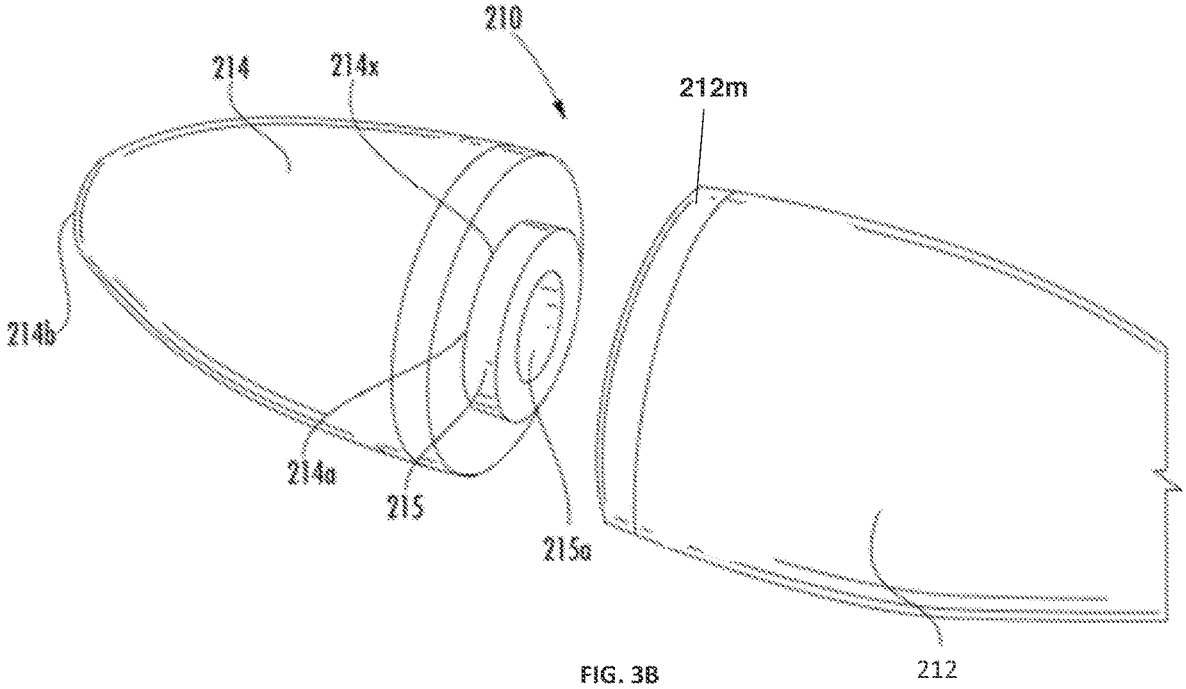
FIG. 3B is a right perspective view of the clasp of FIG. 3A shown in the open condition.
Figure 3C:
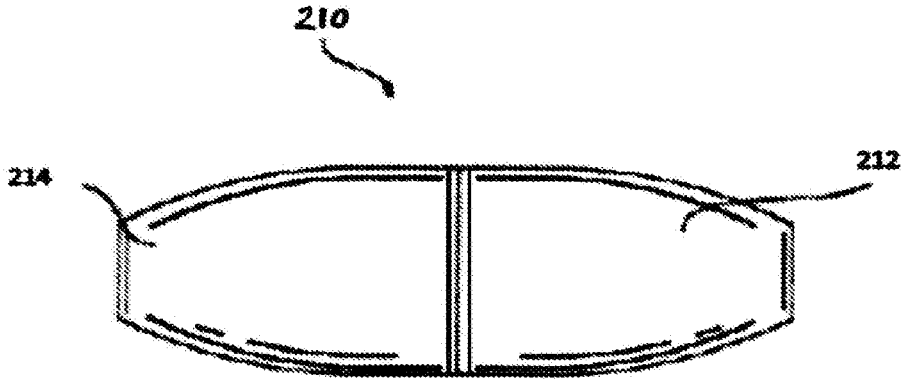
FIG. 3C is a front view of the clasp of FIG. 3A shown in a closed condition.

As shown in FIGS. 3A-3C, a clasp 210 may include all of the features described above with reference to clasp 210 but also includes mating male and female parts which may facilitate an improved securing relationship between the first and second parts 212, 214. Preferably, the interaction extent to which the male part engages the female part will be limited such that such engagement would not significantly inhibit separation of the first and second parts 212, 214 upon a sufficient bending force being applied relatively applied to the first and second parts 212, 214. Further the male part 215 may be beveled to further facilitate separation of the first and second parts 212, 214 upon such relative bending force being applied. Advantageously, such interaction of the male and female parts of the first and second parts would facilitate proper alignment and placement of the first and second parts 212, 214 relative to one another without significantly preventing opening of the clasp thereafter in response to a variety of force that may be applied to the clasp 210.

For convenience, like elements in the clasp 210 uses the name reference numbers as those described with reference to the clasp 210. The first part 212 of the clasp 210 may be substantially similar to the first part 212 as described above, and the second part 214 may be substantially similar to the second part 214 except that it includes a male part 215 at the proximal end 214*a* of the second part 214. An opening 212*x* in the first part 212 may serve as a corresponding female part 220 for the reception of the male part 215 therein. The male part 215 may be formed from a magnetic or a ferrous material and/or may be part of a magnet 214*m*. The male part 215 may be configured to be received within the opening 212*x* of magnet 212*m* and/or within the opening 212*x* at the proximal end 112*a* of the first part 112. The male part 215 may have an opening 215*a* which is positioned to correspond to the opening 214*x* of the second part such that the center of both openings 214*x* and 215*a* are the same. Moreover, opening 215*a* may be sized to receive the knotted first end 116*a* or 116*b* therein, and the opening 214*b* being sized to inhibit the knotted first end 116*a* or second end 116*b* from being removed therefrom. The length and materials of the male part 215 may be such that a predictable degree of force is necessary to cause the clasp 210 to open as the male part 215 is withdrawn from within the opening 212*x* of the first part of the clasp 210. In some embodiments, such frictional connection may be used instead of or in addition to the magnetic attraction between the first and second parts 212, 214 of the clasp 210 as the locking mechanism of the clasp 210. However, as discussed, the first and second parts 212, 214 preferably engage one another in a limited sense frictionally and mostly magnetically such that when a bending force is applied relative to the first and second parts 212, 214, the separation of the first and second parts 212, 214 from such bending force is not substantially impeded.

A method of assembling the necklace system 100 will now be described below.

A method of assembling the necklace system 100 may include providing the string 116 and a plurality of beads 118. Each bead 118, as described above may include an opening extending through the bead 118 through which the string 118 may be received. Once a desired number of beads 118 are placed upon the string 118, the ends of the string 116, the first part 112 may be slid onto the first end 116*a* of the string 116 through the opening 112*y* and out through the opening 112*x* at the proximal end 112*a* thereof. Thereafter, the string 116 may be knotted thereafter at the first end 116*a* to prevent the first part 112 of the clasp 110 from being removed from the string 116. Similarly, the second end 116*b* of the string 116 may be pulled though the opening 114*y* at the distal end 114*b* of the second part 114 and out through the opening 114*x* at the proximal end 114*a* of the second part 114. Thereafter, the second end 116*b* of the string 116 may be knotted to prevent the second part 114 of the clasp 110 from being removed. The clasp 210 may be used instead and may replace the clasp 110.

A method of using the necklace system 100 is now discussed. During use, a user may place the necklace around her neck or that of a child. The opposing proximal ends 112*a*, 114*a* of the first and second parts 112, 114 may be placed in proximity with one another such that the ends 112*a*, 114*a* are magnetically attracted to one another and the clasp 110 transitions to a releasably closed state. In the event that the string 116, a bead 118, or the clasp 110 becomes caught on an object, the weight of the user would exert a force. Upon the exertion of the predetermined tensile force F, the clasp 110 transitions to the open condition without breaking the string 116 or causing damage to the wearer. The clasp 210 may be used instead and may replace the clasp 110.

Reference will now be made in detail to several embodiments of the disclosure that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These and similar directional terms should not be construed to limit the scope of the disclosure in any manner.

Having described at least one of the preferred embodiments of the present disclosure with reference to the accompanying drawings, it is to be understood that such embodiments are merely exemplary and that the disclosure is not limited to those precise embodiments, and that various changes, modifications, and adaptations may be effected therein by one skilled in the art without departing from the scope or spirit of the disclosure as defined in the appended claims. The scope of the disclosure, therefore, shall be defined solely by the following claims. Further, it will be apparent to those of skill in the art that numerous changes may be made in such details without departing from the spirit and the principles of the disclosure. It should be appreciated that the present disclosure is capable of being embodied in other forms without departing from its essential characteristics.

What is claimed is:

1. A clasp for a necklace including a string, the clasp being configured to join a first and a second free end of a string, the clasp comprising:

a first part;

a second part, wherein the first part includes a first surface that is generally planar and a the second part includes a second surface that is generally planar, the first and second surfaces being magnetically attracted to one another by magnetic elements at least partially disposed within each of the first and second parts, the magnetic elements being spaced apart from exterior lateral surfaces of each of the first and second parts such that only part of the first and second surfaces are magnetically attracted to one another, the clasp being transitionable between an open condition and a closed condition in which the first and second surfaces are magnetically secured to one another along a single common plane that is orthogonal relative to a lengthwise extending axis of the clasp when in the closed condition, wherein when the first and second parts are magnetically secured to one another, all portions of the first and second parts are proximal relative to the single common plane such that no portion of the first and second part extends past the single common plane in a direction toward one another when the first and second parts are magnetically secured to one another, the clasp being configured to transition to the open condition in response to a tensile force of a predetermined magnitude pulling the first and second parts away from one another, wherein an application of a force upon the first part relative to the second part to effect an angular movement of the first part relative to the second part results in the clasp transitioning to the open condition when the applied force reaches a threshold value, wherein only the magnetic attraction of the first and second parts to one another inhibits the clasp from transitioning to the open condition; and throughholes extending lengthwise along respective axes extending along respective lengths of the first part and the second part, each of the first and second surfaces of the first part and the second part being generally orthogonal relative to the respective axes extending along respective lengths of the first part and the second part, the throughholes being configured to receive and secure a portion of the string therein such that the string is secured to the clasp, wherein the first part and the second part, when coupled together, define a shape having axial symmetry along the length of the coupled first and second parts, each of the first part and the second part being tapered along respective lengths of the first part and the second part along both an exterior surface and inner surface of respective ones of the first and second parts such that each of a first knotted end and a second knotted end of the string are passable through respective ones of the throughholes when moved in a first direction and inhibited from being removed through the respective ones of the throughholes when moved in a second direction, and wherein each of the magnetic elements is at least partially embedded within and frictionally secured within respective ones of the first and second parts, each of the magnetic elements defining a depth having a distance extending at least partially along and through the length of the respective first and second parts.

2. The clasp, of claim 1, wherein at least one of the first and second parts includes a magnet and the other of the at least one of the first and second parts includes a ferrous material, the magnet being magnetically attracted to the ferrous material.

3. The clasp of claim 1, wherein:

the first and second parts are each generally hollow and each have an interior space that generally approximates an exterior shape of respective ones of the first and second parts.

4. The clasp of claim 1, wherein:

the first part and the second part, when coupled together, define a prolate spheroid shape.

5. A necklace system including a clasp and a string, the clasp comprising:

a first part; and a second part, the clasp being transitionable between an open condition and a closed condition;

the first and second parts including generally planar surfaces that are configured to be releasably attached to one another by a magnetic connection along a common plane that is orthogonal relative to a lengthwise extending axis of the clasp when in the closed condition, the generally planar surfaces of the first and second parts being magnetically coupled to one another along the common plane when in the closed condition;

the first and second parts being magnetically attracted to one another by magnetic elements at least partially disposed within each of the first and second parts, the magnetic elements being spaced apart from exterior lateral surfaces of each of the first and second parts such that only part of the first and second surfaces are magnetically attracted to one another, the closed condition being when the surfaces of the first and second parts are positioned on one another and the open condition being when the surfaces of the first and second parts are spaced apart from one another, wherein only the magnetic attraction of the first and second parts relative to one another inhibits the clasp from transitioning to the open condition, and wherein application of a force meeting a threshold value that effects an angular movement of the first and second parts relative to one another results in the clasp transitioning to the open condition, wherein when the first and second parts are magnetically secured to one another, all portions of the first and second parts are proximal relative to the single common plane such that no portion of the first and second part extends past the single common plane in a direction toward one another when the first and second parts are magnetically secured to one another; and the first and second parts each including a throughhole extending lengthwise along an axis extending along a length of each the first part and the second part, each of the generally planar surfaces of the first part and the second part being generally orthogonal relative to the axis extending along the length of each of the first and second parts, the throughhole being configured to receive and secure a portion of the string therein;

wherein the string includes knotted first and second ends, the first and second knotted ends inhibiting removal of the string from the throughholes;

wherein the first part and the second part, when coupled together, define a shape having axial symmetry along the length of the coupled first and second parts, each of the first part and the second part being tapered along respective lengths of the first part and the second part along both an exterior surface and inner surface of respective ones of the first and second parts such that each the first and second knotted ends are passable through respective ones of the throughholes when moved in a first direction and inhibited from being removed through the respective ones of the throughholes when moved in a second direction; and wherein each of the magnetic elements is at least partially embedded within and frictionally secured within respective ones of the first and second parts, each of the magnetic elements defining a depth having a distance extending at least partially along and through the length of the respective first and second parts.

6. The necklace system of claim 5, wherein:

the first and second parts are each generally hollow and each have an interior space that generally approximates an exterior shape of respective ones of the first and second parts.

7. The clasp of claim 5, wherein:

the first part and the second part, when coupled together, define a prolate spheroid shape.

8. A jewelry clasp for a necklace or bracelet, the jewelry clasp comprising:

a first part including a first planar surface; and a second part including a second planar surface, the first part and the second part being magnetically couplable to one another upon contact of the first planar surface and the second planar surface; and wherein a magnetic element is at least partially embedded within at least one of the first and second parts, the magnetic element defining a depth that extends at least partially through a length of the at least one of the first and second parts away from a respective one of the first and second planar surfaces, the magnetic element being entirely spaced apart from the respective one of the first and second planar surfaces.

9. The jewelry clasp of claim 8, wherein:

the coupled first and second parts define a prolate spheroid configuration.

10. The jewelry clasp of claim 8, wherein:

the first part includes a first through hole that extends lengthwise therethrough, the through hole having a width that tapers to a narrower dimension in a direction away from the first planar surface along a length of the first part; and the second part includes a second through hole that extends lengthwise therethrough, the through hold having a width that tapers to a narrower dimension in a direction away from the second.

11. The jewelry clasp of claim 8, wherein:

the first and second parts being magnetically attracted to one another by magnetic elements at least partially disposed within each of the first and second parts, the magnetic elements being spaced apart from exterior lateral surfaces of each of the first and second parts such that only part of the first and second surfaces are magnetically attracted to one another.

12. The jewelry clasp of claim 8, wherein:

when the first and second parts are magnetically coupled to one another, the first and second parts generally define a prolate spheroid shape.

13. The clasp of claim 8, wherein:

the first and second parts are each generally hollow and each have an interior space that generally approximates an exterior shape of respective ones of the first and second parts.

* * * * *